US011498231B1

(12) United States Patent
Davis

(10) Patent No.: US 11,498,231 B1
(45) Date of Patent: Nov. 15, 2022

(54) UTILITY CUTTER

(71) Applicant: Raymond E Davis, Heath, TX (US)

(72) Inventor: Raymond E Davis, Heath, TX (US)

( * ) Notice: Subject to any disclaimer, the term of this patent is extended or adjusted under 35 U.S.C. 154(b) by 0 days.

(21) Appl. No.: 17/460,226

(22) Filed: Aug. 29, 2021

(51) Int. Cl.
*B26B 5/00* (2006.01)
*B26B 1/08* (2006.01)
*B25G 1/08* (2006.01)

(52) U.S. Cl.
CPC ..... *B26B 5/003* (2013.01); *B25G 1/08* (2013.01); *B26B 5/005* (2013.01)

(58) Field of Classification Search
None
See application file for complete search history.

(56) References Cited

U.S. PATENT DOCUMENTS 4,713,885 A * 12/1987 Keklak ..... B26B 5/003 30/162
5,426,855 A * 6/1995 Keklak ..... B26B 5/003 30/162
6,813,833 B2 * 11/2004 Saunders ..... B26B 5/003 30/162
8,220,160 B2 * 7/2012 Davis ..... A45F 5/02 30/162
8,572,852 B1 * 11/2013 Jennings ..... B26B 5/003 30/162
10,245,736 B2 * 4/2019 Huang ..... B26B 5/001
10,800,053 B1 * 10/2020 Liu ..... B26B 5/003
11,084,178 B2 * 8/2021 Huang ..... B26B 5/003
2004/0226175 A1 * 11/2004 Ping ..... B26B 1/042 30/340
2007/0074402 A1 * 4/2007 Hernandez ..... B26B 5/001 30/162
2013/0067751 A1 * 3/2013 Davis ..... B26B 5/003 30/162
2016/0325442 A1 * 11/2016 Herlitz ..... B26B 1/08
2018/0311839 A1 * 11/2018 Huang ..... B26B 5/001

* cited by examiner

*Primary Examiner* — Hwei-Siu C Payer
(74) *Attorney, Agent, or Firm* — Baker Law Firm

(57) ABSTRACT

An auto-retracting utility cutter includes a cutter body, a handle and an access door enabling top loading of replaceable blades into an slidable internal blade carriage. The blade carriage is actuated when sufficient force is applied to a linkage connected to the blade carriage which overcomes the inertia of the linkage but is resistant to casual squeezing and prevents injury from inadvertent deployment of the blade.

4 Claims, 5 Drawing Sheets

FIG. 1
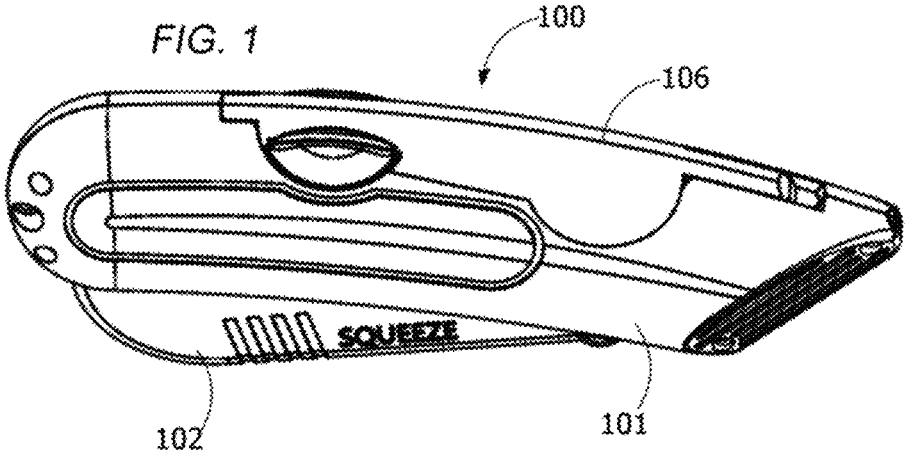
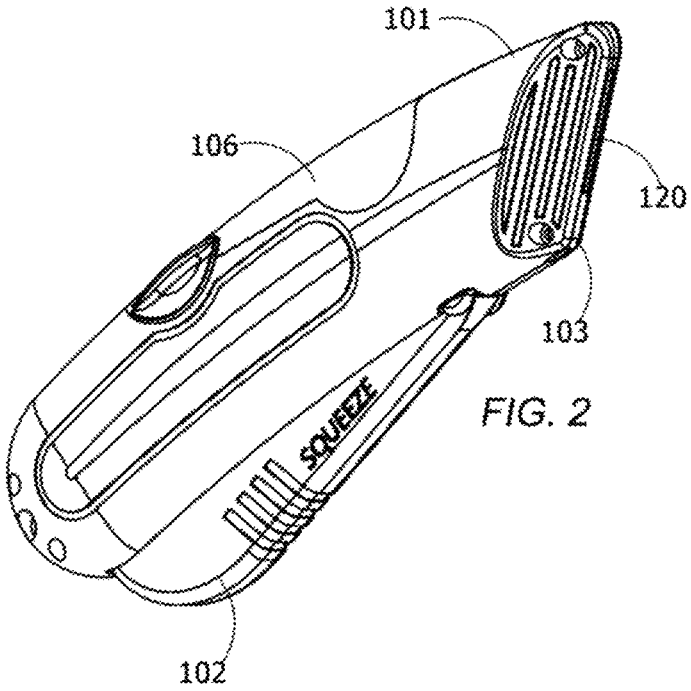
FIG. 2

UTILITY CUTTER

TECHNICAL BACKGROUND

This disclosure relates to utility knives or cutters, particularly those used in the packaging industry.

BACKGROUND

Utility cutters may be used to cut or slice a variety of materials, such as cardboard, corrugated board of varying thickness, rubber, lightweight plastic, or other packaging material. In order to cut or slice such material, the utility cutter may need to have a sharpened blade. Certain precautions may be used to protect or help protect a user from the sharpened blade.

SUMMARY

In one general implementation, a utility cutter includes a body with a blade carriage adapted to receive replaceable utility blades, the body includes a handle, and the blade carriage actuated by squeezing the handle and when the handle is released the blade carriage is retracted into the body.

In a second aspect combinable with any of the previous aspects, the handle is connected to a linked pair of pivotable arms, the pivotable arms of the linkage include a resting state where the arms form a "V" shaped arrangement, and where the arms are set at an inside angle less than 90 degrees.

In a third aspect combinable with any of the previous aspects, the handle is configured to move against a joint connecting the pivotable arms, and thereby angularly and pivotably move the arms apart such that the inside angle between the arms is greater than 90 degrees.

In a fourth aspect combinable with any of the previous aspects, moving the pivotable arms resting at an inside angle less than 90 degrees to a position where the inside angle is greater than 90 degrees requires a force of at least 0.8 kilogram.

In a fifth aspect combinable with any of the previous aspects, the body includes a pivotable door that is configured to expose a top-loading aperture of the blade carriage.

In a sixth aspect combinable with any of the previous aspects, the blade carriage is connected to a spring that retains the carriage in a normally retracted position within the body.

In a seventh aspect combinable with any of the previous aspects, the blade loading aperture of the blade carriage includes a moveable blade retention member.

In an eighth aspect combinable with any of the previous aspects, the cutter body has a hardened member disposed beneath the blade slot to guard against possible wearing away of a plastic body.

In a ninth aspect combinable with any of the previous aspects, the handle has an inherent resistance to being initially depressed owing to the linked pair of pivotable arms with a resting inside angle of less that 90 degrees, similar to a dead center that must be overcome with an initial squeezing force typically between 0.8 kg-1.5 kg.

In a tenth aspect combinable with any of the previous aspects, the linked pair of pivotable arms while in a resting position, where the handle is not squeezed, includes an inside angle between the arms of preferably and generally between 70 and 89 degrees, and more preferably, residing in a range between 80 and 88 degrees.

In an eleventh aspect combinable with any of the previous aspects, the inside angle between the pivotable arms is prevented from dropping below 70 degrees by a stop element.

In a twelfth aspect combinable with any of the previous aspects, the pivotable linkage, in its resting state, when the handle is not depressed, is compressed to its minimum inside angle by a retracting spring connected to the blade carriage.

These general and specific aspects may be implemented using a device, system or method, or any combinations of devices, systems, or methods. The details of one or more implementations are set forth in the accompanying drawings and the description. Other features, objects, and advantages will be apparent from the description and drawings, and from the claims.

BRIEF DESCRIPTION OF THE DRAWING FIGURES

FIG. 1 is a side elevation of an example utility cutter according to the present invention;

FIG. 2 is a perspective view showing an exterior thereof;

REFERENCE LISTING OF THE NAMED ELEMENTS

Figure 3:
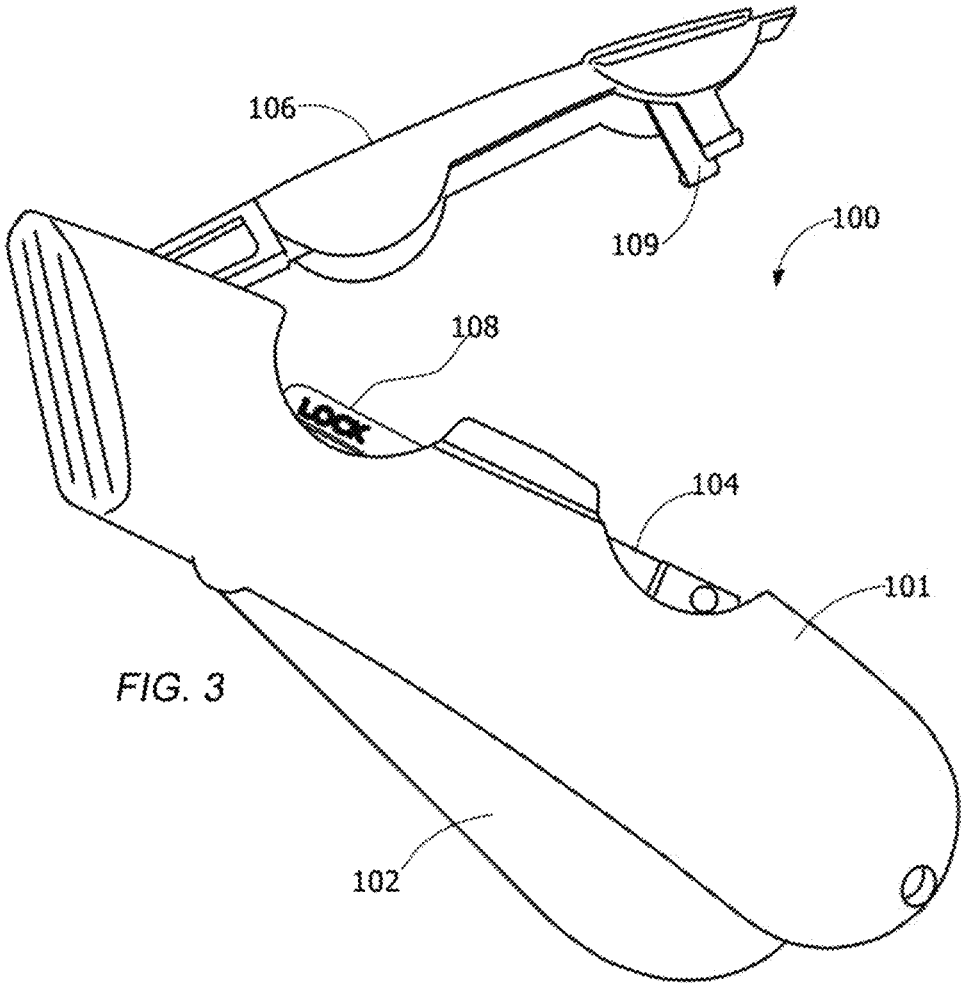
FIG. 3 is a perspective view showing an exterior of the body with a blade carriage access door opened.

100 utility knife
101 body
102 handle
102*a* handle pivot
103 anti-wear edge
104 blade carriage
105 carriage slide
106 blade carriage access door
107 top-loading aperture
108 blade securing latch
109 access door latch
110 blade
111 linkage
112*a* link arm
112*b* link arm
112*c* translatable joint
112*d* spring
113 rotatable pivot
114 linkage stop
116 carriage roller
117 eccentric slot
118 follower portion
119 spring anchor
120 blade slot

DEFINITIONS

In the following detailed description, the singular terms "a", "an", and "the" include plural referents unless the context clearly indicates otherwise. Similarly, the word "or is intended to include "and" unless the context clearly indicates otherwise. Although methods and materials similar or equivalent to those described herein can be used in the practice or testing of this disclosure, suitable methods and materials are described below. It should be understood that the objects, features and aspects of any implementation/embodiment disclosed herein may be combined with any object, feature or aspect of any other implementation/embodiment without departing from the scope of the invention. The term "comprises" means "includes." All publications, patent applications, patents, and other references mentioned herein are incorporated by reference in their entirety for all purposes. In case of conflict, the present specification, including explanations of terms, will control. In addition, the materials, methods, and examples are illustrative only and not intended to be limiting.

Referring generally to FIGS. 1-9 a safety utility cutter (100) includes a body (101) and a handle (102). Inside the body is a slidable blade carriage (104) actuated by depressing the handle (102) which is linked to the blade carriage by a follower portion (118) at the end of one of two pivotably connected arms (112*a*, 112*b*) forming a linkage (111). Medially disposed between the follower portion (118) connected to the blade carriage and a non-translatable but rotatable pivot (113) is a translatable joint (112*c*) where the two arms (112*a*, 112*b*) pivotably connect. When joint (112*c*) translates; e.g., moves laterally, by the application of force against the joint (112*c*) by squeezing handle (102), an inside angle between the two arms of the linkage (111) moves from an acute angle to an obtuse angle and thereby slides the blade carriage (104) and held blade (110) forward. A force between 0.8 kg and 1.5 kg caused by squeezing handle (102) and bearing on translatable joint (112*c*), is required to increase the inside angle between arms (112*a*, 112*b*). Typically the resting position of the linkage (111) exists when the handle is released. When the handle (102) is squeezed or depressed with a force, the inertia of the acute angular position is overcome and the linkage assumes an obtuse angle between the pivotable arms, thereby moving the blade carriage forward and exposes the blade for cutting purposes. When the handle (102) is released, a spring (112*d*), which in some implementations may be a coil type spring or an elastomeric band, is attached at one end to the blade carriage (104) and to the body interior at another, retracts the blade carriage and the held blade (110).

FIG. 1 is a side view of an example cutter showing a body (101), that includes a blade assembly access door (106) and a handle (102). FIG. 2 is a perspective view of the example cutter.

Figure 4:
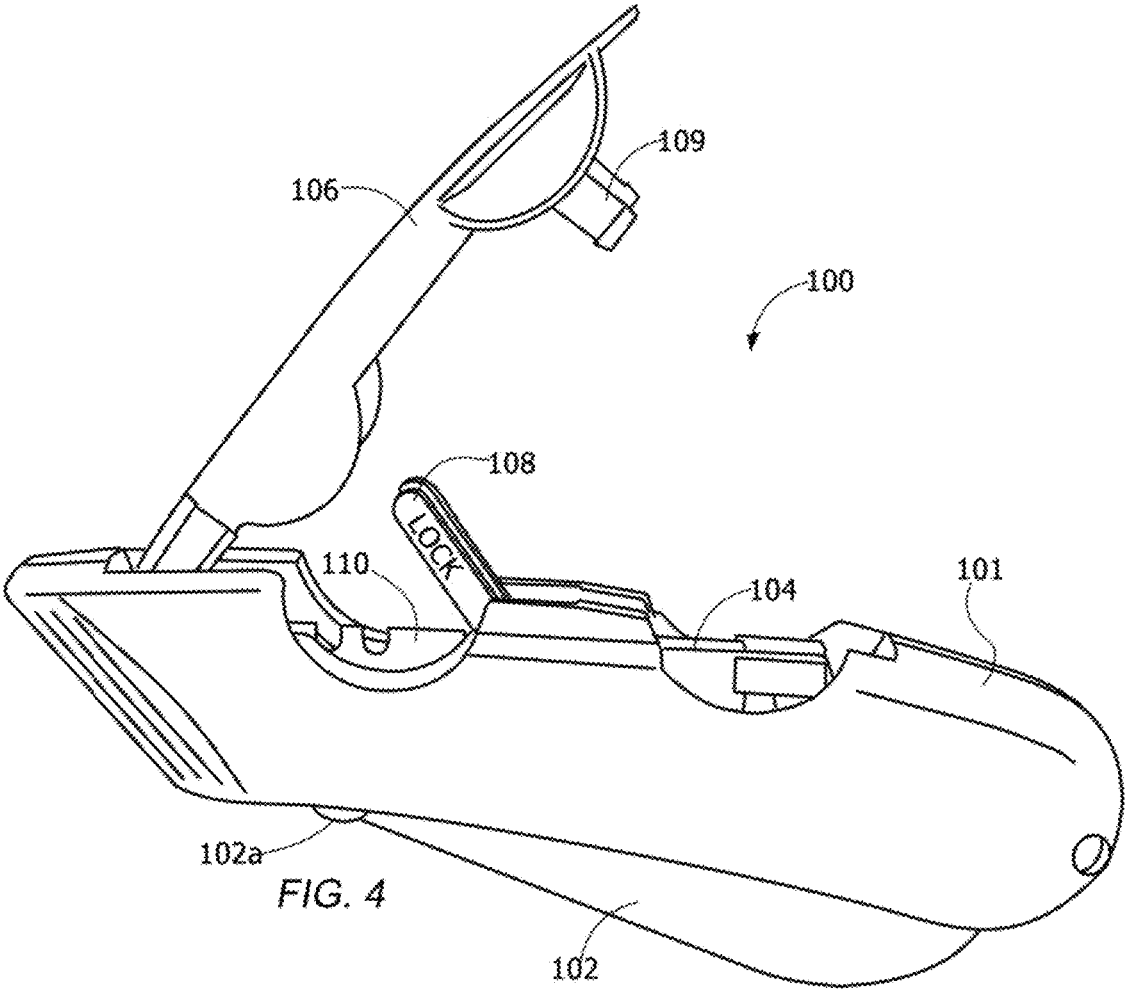
FIG. 4 is a perspective view showing an exterior of the body with a blade carriage access door opened and a blade securing latch in an opened position.

FIGS. 3 and 4 are perspective views showing the assembly access door (106) in an open position which exposes portions of the blade assembly carriage (104). FIG. 4 shows a blade securing latch in an up position which allows the top loading of replaceable blades (110) into the blade carriage (104).

Figure 5:
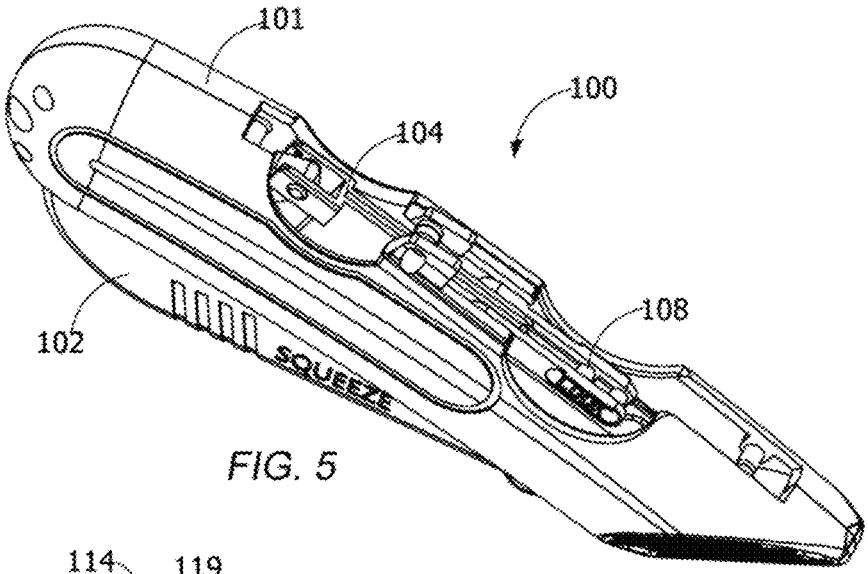
FIG. 5 is a perspective view showing an exterior of the body with a blade carriage access door removed.
Figure 6:
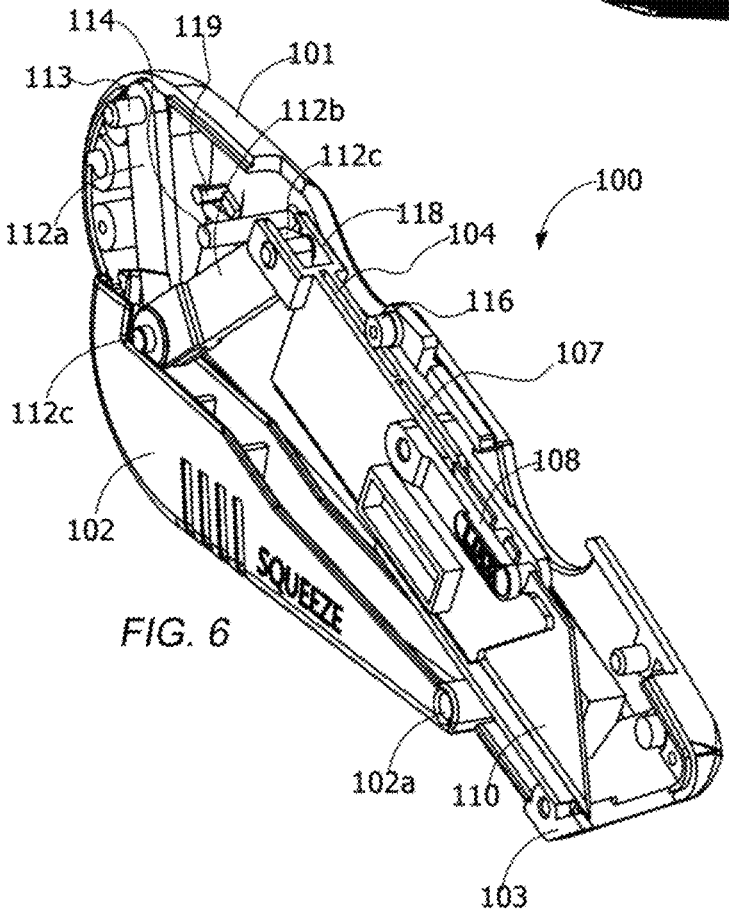
FIG. 6 is a perspective view showing an interior of the body.

FIG. 5 is a perspective view of the example cutter (100) which shows an interior of the cutter body (101). FIG. 6 shows blade carriage (104) which is configured to slide between carriage slide (105) below the carriage, and roller (116) above the carriage which produces smooth linear movement. Linkage (111) includes arm (112*a*) which is secured to the body (101) at rotatable pivot (113) and a second arm (112*b*) which is secured to arm (112*a*) at translatable joint (112*c*), and second arm (112*b*) is connected to the blade carriage at follower (118) as shown. Blades (110) are removable from the carriage and insertable into the blade carriage (104) via top loading apertures (107), and the installed blades are secured by fold down latch (108) which may typically engage with the notches found in common utility blades.

Figure 7:
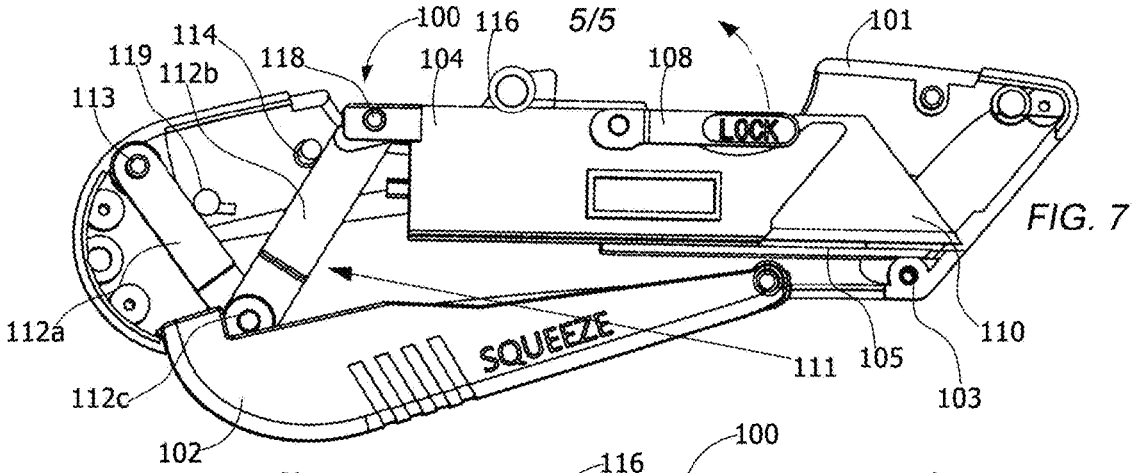
FIG. 7 is a side view showing an interior of the body with blade carriage in retracted position.
Figure 8:
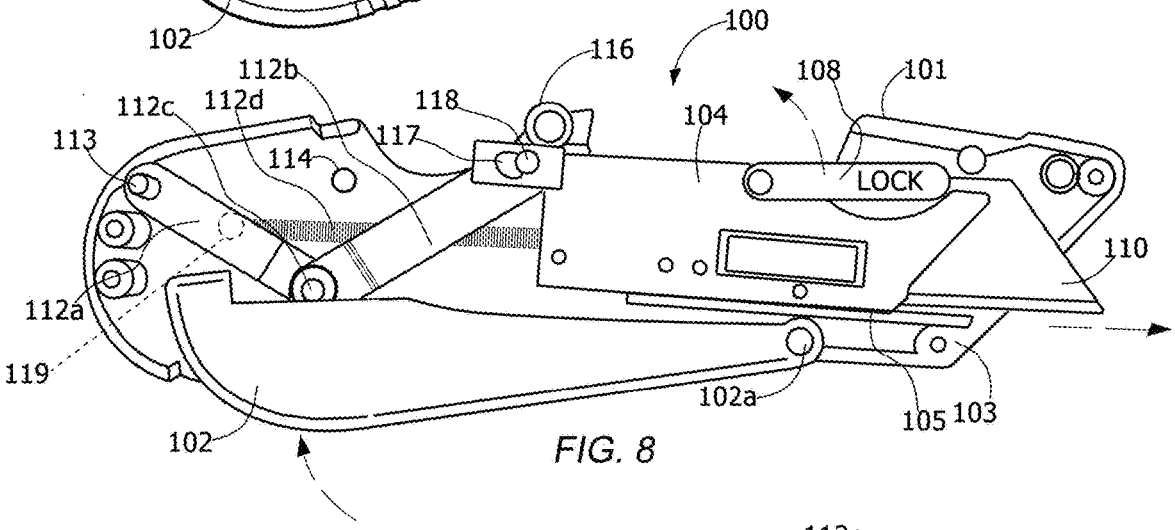
FIG. 8 is a side view showing an interior of the body with blade carriage in extended position.

FIG. 7 is a side view showing an interior of the example cutter (100). When handle (102) is squeezed with a force of at least 0.8 kg, an inner portion of the handle bears against joint (112*c*) causing linkage (111) to translate as shown in (FIG. 8). Initially (FIG. 7) inside angle f between arms (112*a*, 112*b*) is less than 90 degrees. Squeezing/depressing the handle then causes the arms to move apart as joint (112*c*) slides along an inner surface of the handle causing arm (112*b*) to push the blade carriage (104) forward via follower (118) entrapped in eccentric slot (117). When the handle is released spring (112*d*) pulls the blade carriage (104) rearwardly and retracts the blade (110) back into the body. In this way the blade auto-retracts when the handle is not being depressed.

Figure 9:
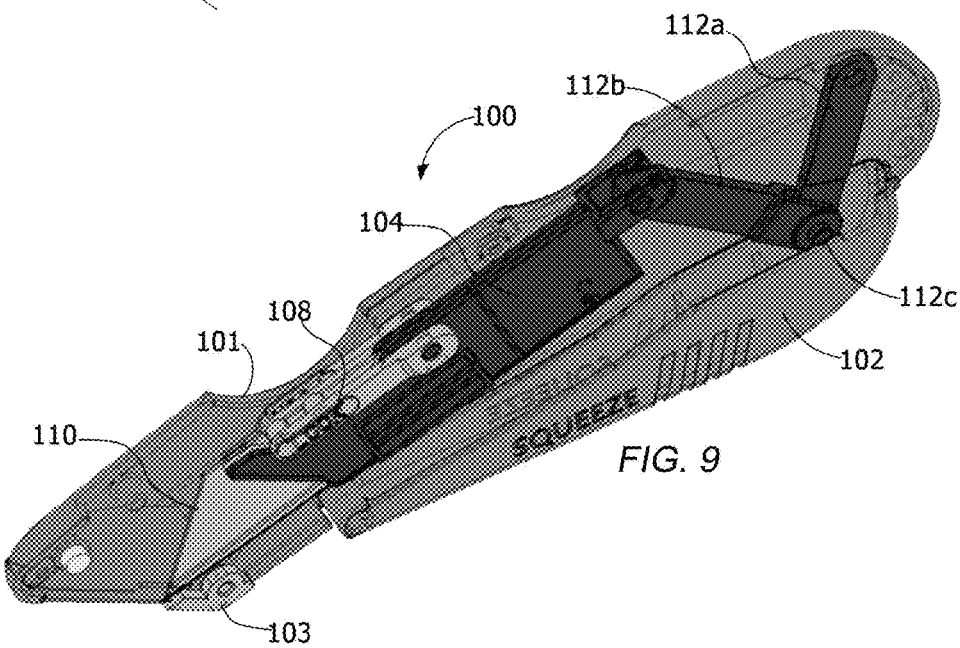
FIG. 9 is a perspective view of an interior of the example utility cutter.

FIG. 9 is a perspective view showing the interior workings of the example cutter (100) and a wear guard (103) that protects a portion of the body (101) below the cutting edge of blade (110) from excessive wear.

It should be understood that the drawings and detailed description herein are to be regarded in an illustrative rather than a restrictive manner, and are not intended to be limiting to the particular implementations, forms and examples disclosed. Accordingly, it is intended that this disclosure encompass any further modifications, changes, rearrangements, substitutions, alternatives, design choices, and implementations as would be appreciated by those of ordinary skill in the art having benefit of this disclosure, and falling within the spirit and scope of the following claims.

What is claimed is:

1. A utility cutter apparatus comprising:

a body with a depressible handle;

a blade carriage configured to house at least one blade, the blade carriage slidably movable within the body, the blade carriage actuable by the depressible handle via a linkage;

the linkage including a pair of pivotably connected arms: a forward arm of the pair connected to the blade carriage and a rearward arm of the pair pivotably attached to the body; and, the linkage having a resting position where an inside angle between the pair of arms is less than 90 degrees and at least one tensioned active position where the inside angle between the pair of arms is greater than 90 degrees and the at least one blade is translated to an exposed position exterior to the body;

a spring member having a first end to the rearward arm and a second end connected to the blade carriage bypassing the forward arm and configured to retract the carriage and the at least one blade from the exposed position; and, a linkage stop transversely disposed between the forward and rearward arms;

a blade carriage access door disposed on a top side of the body, the blade carriage further comprising a flip up blade securing latch at the top side of the blade carriage and accessible directly beneath the blade carriage access door.

2. The utility cutter apparatus according to claim 1, the blade carriage access door configured to expose a blade re-fill slot disposed atop the blade carriage and adapted to receive replacement blades.

3. The utility cutter apparatus according to claim 1, the depressible handle requires an initial squeezing force of at least 1 kg required to depress the handle and move the blade carriage from the resting position to the active position.

4. The utility cutter apparatus according to claim 1, the blade configured to retract when force is relieved from the depressible handle.

* * * * *